United States Patent [19]

Persson et al.

[11] 4,402,465

[45] Sep. 6, 1983

[54] WEAR LINING OF RUBBER FOR ROTATABLE DRUMS

[75] Inventors: Sture Persson, Skellefteå; Mats Åhlund, Ersmark, both of Sweden

[73] Assignee: Skega Aktiebolag, Ersmark, Sweden

[21] Appl. No.: 269,587

[22] Filed: Jun. 2, 1981

[30] Foreign Application Priority Data

Jun. 10, 1980 [SE] Sweden ..... 8004323

[51] Int. Cl.[3] ..... B02C 17/22

[52] U.S. Cl. ..... 241/183

[58] Field of Search ..... 241/102, 182, 183

[56] References Cited

U.S. PATENT DOCUMENTS

| | | | |
|---|---|---|---|
| 2,058,257 | 10/1936 | Porteous | 241/182 X |
| 3,107,867 | 10/1963 | Suensson et al. | 241/102 |
| 3,378,209 | 4/1968 | Crocheron | 241/182 X |
| 4,052,014 | 10/1977 | Jonsson | 241/183 |
| 4,289,279 | 9/1981 | Brandt | 241/102 |

*Primary Examiner*—Howard N. Goldberg

*Attorney, Agent, or Firm*—Cushman, Darby & Cushman

[57] ABSTRACT

This invention relates to a wear metals lining of rubber for rotatable drums with several adjacent sections of separate lifting members, and separate lining plates arranged between these, the lifting members being pressed against the wall of the drum by means of rails secured by mounting bolts, retaining adjacent lining plates and being provided with slits, in which the rails are placed. In order to be able to use soft rubber in such a lining, i.e. a rubber with a hardness below 60 Shore, in the lifting members without giving up the demand on an elastic attachment at least the parts of the slit (4), on which the mounting rail (7) bears, are provided with a fabric (11) taking up the tensile forces arising when the lifting members (3) are exposed to a lateral load.

5 Claims, 2 Drawing Figures

WEAR LINING OF RUBBER FOR ROTATABLE DRUMS

Figure 1:
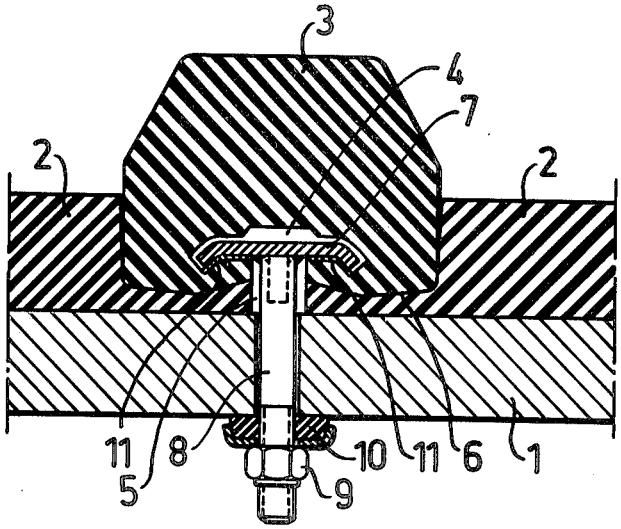

This invention relates to a wear lining of rubber for rotatable drums, such as ball or tube mills and the like, with several adjacent sections of separate lifting members and separate lining plates arranged between these, the lifting members being pressed against the wall of the drum by means of rails secured by mounting bolts, retaining adjacent lining plates and being provided with longitudinal slits formed with an opening against the drum wall, in which slits the rails are placed.

E.g. Swedish Pat. No. 227 559 discloses wear linings of the type indicated above and consisting of rubber. However, this type of wear lining cannot be used where there is a risk of the lifting members being exposed to great lateral forces, unless the lifting members are made of rubber having a hardness of at least 70 Shore. However, at such a hardness the rubber has lost to an essential extent its elastic properties important with respect to wear, the consequence being a reduced length of life. Due to the fact that the elastic properties of the rubber are of such a decisive importance to the life of the lifting members it is as a rule aimed at being able to use rubber having a hardness down to 50–40 Shore in such members, but as stated this has not turned out to be possible at wear linings of the above-mentioned type quite simply on account of the fact that rubber with such a low hardness has too low a tensile strength.

It is also known to give the mounting rail and the respective slit in the lifting members in a wear lining a shape similar to a wave and in this way a much better security for the lifting members in respect of the lateral forces arising during the rotation e.g. of the drum of a tube mill has been obtained. This known construction brings a very high movability of the lifting members of the wear lining, which has turned out to be of an extraordinarily great advantage as the lifting members owing to this can spring away when exposed to lateral forces, and in this way the surface pressure is also reduced and a highly essential reduction of the wear is obtained. However, also in this case the possibility of using soft rubber qualities in the lifting members is restricted due to the too great risk of rubber being torn or worn away in the part of attachment of the lifting members under the mounting rail consisting of steel at rubber hardnesses down to 60–40 Shore.

Another way of solving the problem with securing the lifting members of the wear lining is vulcanizing these members onto a steel rail which is then attached by means of a T-bolt or other bolts to the mantle or shell of the drum. By the vulcanization of the lifting members consisting of rubber by means of the steel rail there is, however, the disadvantage that the rubber is stiffened and will have an essentially reduced ability of springing away, which results in increased surface stresses and consequently a higher wear and shorter life.

It is therefore the object of this invention to eliminate the above-mentioned disadvantage of known wear linings and to provide such a lining that allows safe securing of the lifting members even if these are made of soft rubber, i.e, rubber with a hardness below 60 Shore, and are used in such mills where they can be exposed to very great lateral forces without giving up the demand on an elastic attachment which permits a maximum movement of the lifting members and consequently gives rise to the least possible surface pressure.

This is achieved in such a way that the wear lining of the invention has the characteristic features defined in the claims, and more exactly the invention is characterized in that at least the parts of the slit, on which the mounting rail bears, is provided with a flexible fabric taking up the tensile forces arising due to outer influence of the lifting members. This fabric is preferably intimately connected with the rubber by vulcanization.

By the vulcanization of this fabric the tensile strength of the rubber is, however, reinforced without its elastic properties being lost to any considerable degree, and practical tests have also confirmed that a considerable increase of the life of mill linings is obtained by means of the invention owing to the possibility of using rubber with a hardness to the order of 50 Shore relative to 65–70 Shore before. The invention gives also of a possibility of using a softer rubber than 50 Shore in certain situations.

Figure 2:
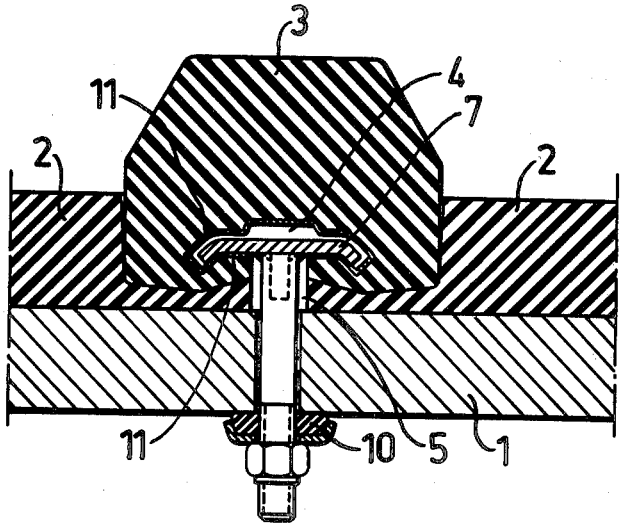

The invention is explained more in detail in the following with reference to the enclosed drawing, in which FIGS. 1 and 2 show a cross section of a lifting member of a first and second embodiment of the wear metals lining of the invention.

In the drawing 1 is a mill mantle or shell against which lining plates 2 consisting of rubber are pressed by lifting means 3, so-called lifters, which also consist of rubber.

The lifters 3 are provided with grooves or slits 4 extending along the entire lifter, which is open to the underside 6 bearing on the adjacent lining plates 2 of the lifter by means of a narrower slit 5.

A mounting rail 7 with welded bolts 8 is placed in the slit 4 of the lifters, which rail extends through the mantle 1 and is provided with nuts 9 on the outside of the mantle for pressing the mounting rail 7 against the lifter 3 and consequently for pressing the lining plates 2 against the mantle 1. Elastic washers 10 are preferably arranged between each nut and mantle.

At least the parts of the walls of the slit, on which the mounting rail 7 bears, is according to the invention provided with a flexible fabric 11, which is intimately connected with the rubber, preferably vulcanized to the rubber as shown in FIG. 1. This fabric takes up the tensile forces arising when the lifter 3 is exposed to outer infuence such as lateral forces and distributes these forces over great surfaces with the consequence that no concentration of forces to a certain place is obtained due to which rubber pieces can be torn and worn away from the lifter.

Therefore rubber with a lesser hardness than even 50 Shore can be used also in such lifters as are exposed to a great outer lateral influence.

The fabric 11 should be flexible and can preferably consist of glass fibre or another suitable material. A steel wire fabric with thin threads is also possible.

In FIG. 2 the fabric 11 is shown as placed around the whole slit 4 and vulcanized to the rubber, which has been found to be especially advantageous, but the fabric can have any other extension between the positions shown in FIGS. 1 and 2 in accordance with the principles on which the invention is based.

The invention is not restricted to what has been described above and shown in the drawing but can be altered and modified in several different ways within the scope of the inventive thought defined in the claims.

We claim:

1. In a wear lining for the shell of a rotatable drum: a rubber lining plate adjacent the inner surface of the shell; and means pressing said lining plate against said inner surface, said means including a rubber lifting member having a first surface facing said lining plate and a second surface facing the interior of the shell, said first surface having a generally T-shaped slit therein in which a mounting rail is located, said rail being attached to said shell by bolt means such that said rail bears against a surface of said slit and such that said lifting member presses said lining plate against the shell; and a fabric intimately connected to said surface of said slit against which said mounting bar bears, said fabric taking up tensile forces arising when the lifting member is exposed to a lateral load.

2. A wear lining as in claim 1 wherein said fabric is vulcanized to said surface.

3. A wear lining as in claim 2 wherein said fabric also engages and is vulcanized to further surfaces of said slit.

4. A wear lining as in claim 1 wherein the material of said fabric is selected from the group consisting of glass fiber, thin steel wire or yarn.

5. A wear lining as in claim 1 wherein the rubber of said lifting member has a hardness of the order of 40–55 Shore.

* * * * *